US008758541B2

(12) United States Patent
Mitchell

(10) Patent No.: US 8,758,541 B2
(45) Date of Patent: Jun. 24, 2014

(54) WRIST PROTECTING GLOVE AND METHODS THEREOF

(76) Inventor: Justin M. Mitchell, Los Angeles, CA (US)

( * ) Notice: Subject to any disclaimer, the term of this patent is extended or adjusted under 35 U.S.C. 154(b) by 37 days.

(21) Appl. No.: 13/154,474

(22) Filed: Jun. 7, 2011

(65) Prior Publication Data

US 2011/0296576 A1 Dec. 8, 2011

Related U.S. Application Data

(60) Provisional application No. 61/351,950, filed on Jun. 7, 2010.

(51) Int. Cl.
*B29C 45/14* (2006.01)
*A41D 19/015* (2006.01)

(52) U.S. Cl.
USPC ..... 156/245; 156/258; 156/298; 264/222; 264/271.1; 264/279; 2/20; 2/161.1; 2/162; 2/169

(58) Field of Classification Search
USPC ..... 156/298, 303.1, 258; 2/16, 20, 161.1, 2/162, 169; 264/222
See application file for complete search history.

(56) References Cited

U.S. PATENT DOCUMENTS

| | | | | |
|---|---|---|---|---|
| 2,473,723 | A * | 6/1949 | Nelson | 264/247 |
| 4,193,134 | A * | 3/1980 | Hanrahan et al. | 2/16 |
| 5,435,007 | A * | 7/1995 | Kalvestran et al. | 2/16 |
| 5,819,313 | A * | 10/1998 | McCrane | 2/16 |
| 6,219,843 | B1 * | 4/2001 | Passi et al. | 2/16 |
| 6,279,159 | B1 * | 8/2001 | Ahlbaumer et al. | 2/20 |
| 2002/0193719 | A1 * | 12/2002 | Yewer, Jr. | 602/21 |
| 2009/0098945 | A1 * | 4/2009 | George | 473/213 |
| 2009/0276933 | A1 * | 11/2009 | Dodd | 2/16 |
| 2010/0186142 | A1 * | 7/2010 | Kume et al. | 2/161.1 |
| 2011/0035864 | A1 * | 2/2011 | Gordon et al. | 2/455 |

* cited by examiner

*Primary Examiner* — William Bell
(74) *Attorney, Agent, or Firm* — Jon Fallon, Esq.; Michael Kochka, Esq.

(57) ABSTRACT

Embodiments of the present invention generally relate to a wrist protecting glove and methods of manufacturing the same. More specifically, embodiments of the present invention relate to a wrist protecting glove providing maximum protection with minimal restriction on range of movement, and method of manufacturing the same. In one embodiment, a wrist protecting glove comprises a polyurethane pad, formed to fit over a user's palm, a holding material integrally formed within the pad, a set of snap fasteners for closing the holding material around a user's thumb, a palm strap for affixing the wrist protecting glove on a user's hand, the palm strap affixed to the holding material, and a D-ring assembly for receiving the palm strap, wherein the palm strap comprises a hook and loop fastener strap for looping through the D-ring assembly and fastening onto itself to affix the wrist protecting glove on the user's hand.

12 Claims, 11 Drawing Sheets

WRIST PROTECTING GLOVE AND METHODS THEREOF

CROSS-REFERENCE TO RELATED APPLICATIONS

This application claims priority to U.S. Patent Application Ser. No. 61/351,950, entitled "Wrist Protecting Glove and Methods Thereof," and filed Jun. 7, 2010, the disclosure of which is incorporated by reference herein in its entirety.

BACKGROUND OF THE INVENTION

1. Field of the Invention

Embodiments of the present invention generally relate to a wrist protecting glove and methods of manufacturing the same. More specifically, embodiments of the present invention relate to a wrist protecting glove providing maximum protection with minimal restriction on range of movement, and method of manufacturing the same.

2. Description of the Related Art

Sports such as skateboarding, rollerblading, snowboarding, are both extremely exciting and quite dangerous. Propelling oneself quickly across a concrete pathway or down the side of a snow/ice-covered mountain can provide an intense adrenaline rush. However, if one should fall on the concrete or in the snow/ice, the enjoyable sensation may quickly depart and be replaced by excruciating pain in the event of an injury.

One of the most common locations for injuries to a skateboarder, rollerblader, or snowboarder, is in the wrist. FIG. 1 depicts a schematic of common skateboarding, rollerblading and snowboarding hand/wrist injuries 100. When no hand or wrist protection is utilized by a skateboarder, rollerblader or snowboarder, it is not uncommon for the person to suffer injuries of the hand 110 and/or wrist 120 when performing tricks or stunts involving the need to brace a hand against the ground, a ramp, or other structure. Similarly, many injuries occur when a skateboarder falls, and subconsciously reaches a hand down to brace the impact of the fall.

The wrist 120 is composed of a junction between finger bones and arm bones, with a fragile core of Carpus bones. Protecting these bones is the key to preventing bruising, spraining and long term wrist injury, as well as immediate fractures. When no protection is utilized, common injuries include sprained ligaments 122 in the wrist or hand, median nerve damage 124, a scaphoidic fracture 126, among several others.

Most protective gloves in the market today suffer from the same problems. On one side of the spectrum, many of the gloves that utilize wrist protection (or separable wrist guards) do so by providing a very rigid polymer board against the wrist, such that the user may not suffer hyperextension or flexor extension in the event of a fall. However, with rigidity comes lack of movement, and thus, the user may be limited in his or her wrist mobility and ability to perform stunts wearing such protection.

On the other end of the spectrum, gloves that allow for wrist mobility generally have either unrestrictive cloth or nothing as a form of wrist protection. In view of the forces experienced when a user falls and puts his or her hand down, as shown in FIG. 1, such minimal protection is futile, and the user is likely to be injured.

As such, there is a need for a wrist protecting glove and methods of manufacturing the same.

SUMMARY

Embodiments of the present invention generally relate to a wrist protecting glove and methods of manufacturing the same. More specifically, embodiments of the present invention relate to a wrist protecting glove providing maximum protection with minimal restriction on range of movement, and method of manufacturing the same.

In one embodiment of the present invention, a wrist protecting glove comprises a pad formed to fit over a user's palm, a holding material integrally formed within the pad, and a palm strap for affixing the wrist protecting glove on a user's hand, the palm strap affixed to the holding material.

In another embodiment of the present invention, a wrist protecting glove comprises a polyurethane pad, formed to fit over a user's palm, a holding material integrally formed within the pad, a set of snap fasteners for closing the holding material around a user's thumb, a palm strap for affixing the wrist protecting glove on a user's hand, the palm strap affixed to the holding material, and a D-ring assembly for receiving the palm strap, wherein the palm strap comprises a hook and loop fastener strap for looping through the D-ring assembly and fastening onto itself to affix the wrist protecting glove on the user's hand.

In yet another embodiment of the present invention, a method of manufacturing a wrist protecting glove comprises: cutting a holding material from a blank of material using a template; forming pad molds by creating an impression in the form of a user's palms; creating pads from a viscous material poured into the molds and allowing the material to harden; affixing the holding material integrally into the pads utilizing a pattern mold; providing a stack of materials underneath the holding material and securing the materials together around a common edge; and affixing a restraining mechanism on the stack of materials, the restraining mechanism for allowing a user to keep the wrist protecting glove on the user's hand during use.

BRIEF DESCRIPTION OF THE DRAWINGS

So the manner in which the above recited features of the present invention can be understood in detail, a more particular description of embodiments of the present invention, briefly summarized above, may be had by reference to embodiments, one of which is illustrated in the appended drawings. It is to be noted, however, the appended drawings illustrate only typical embodiments of embodiments encompassed within the scope of the present invention, and, therefore, is not to be considered limiting, for the present invention may admit to other equally effective embodiments.

Figure 1:
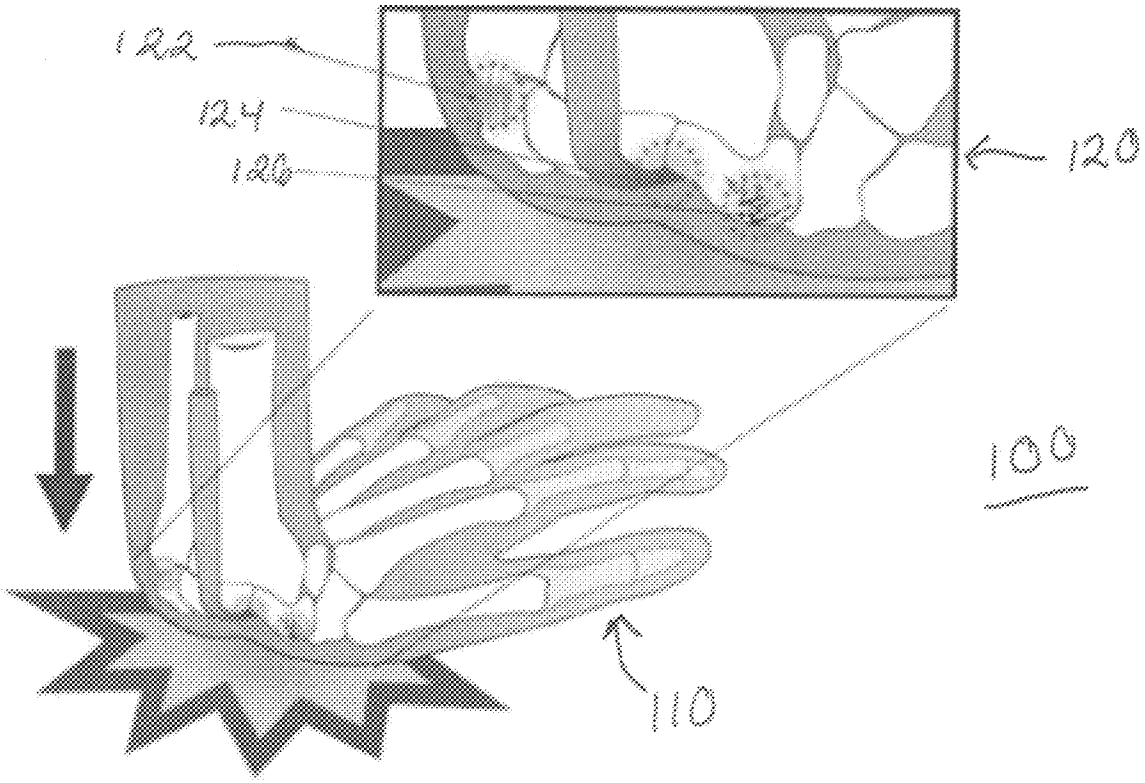
FIG. 1 depicts a schematic of common skateboarding hand/wrist injuries in accordance with one embodiment of the present invention.

The headings used herein are for organizational purposes only and are not meant to be used to limit the scope of the description or the claims. As used throughout this application, the word "may" is used in a permissive sense (i.e., meaning having the potential to), rather than the mandatory sense (i.e., meaning must). Similarly, the words "include", "including", and "includes" mean including but not limited to. To facilitate understanding, like reference numerals have been used, where possible, to designate like elements common to the figures.

DETAILED DESCRIPTION OF THE INVENTION

Embodiments of the present invention generally relate to a wrist protecting glove and methods of manufacturing the same. More specifically, embodiments of the present invention relate to a wrist protecting glove providing maximum protection with minimal restriction on range of movement, and method of manufacturing the same.

Figure 2:
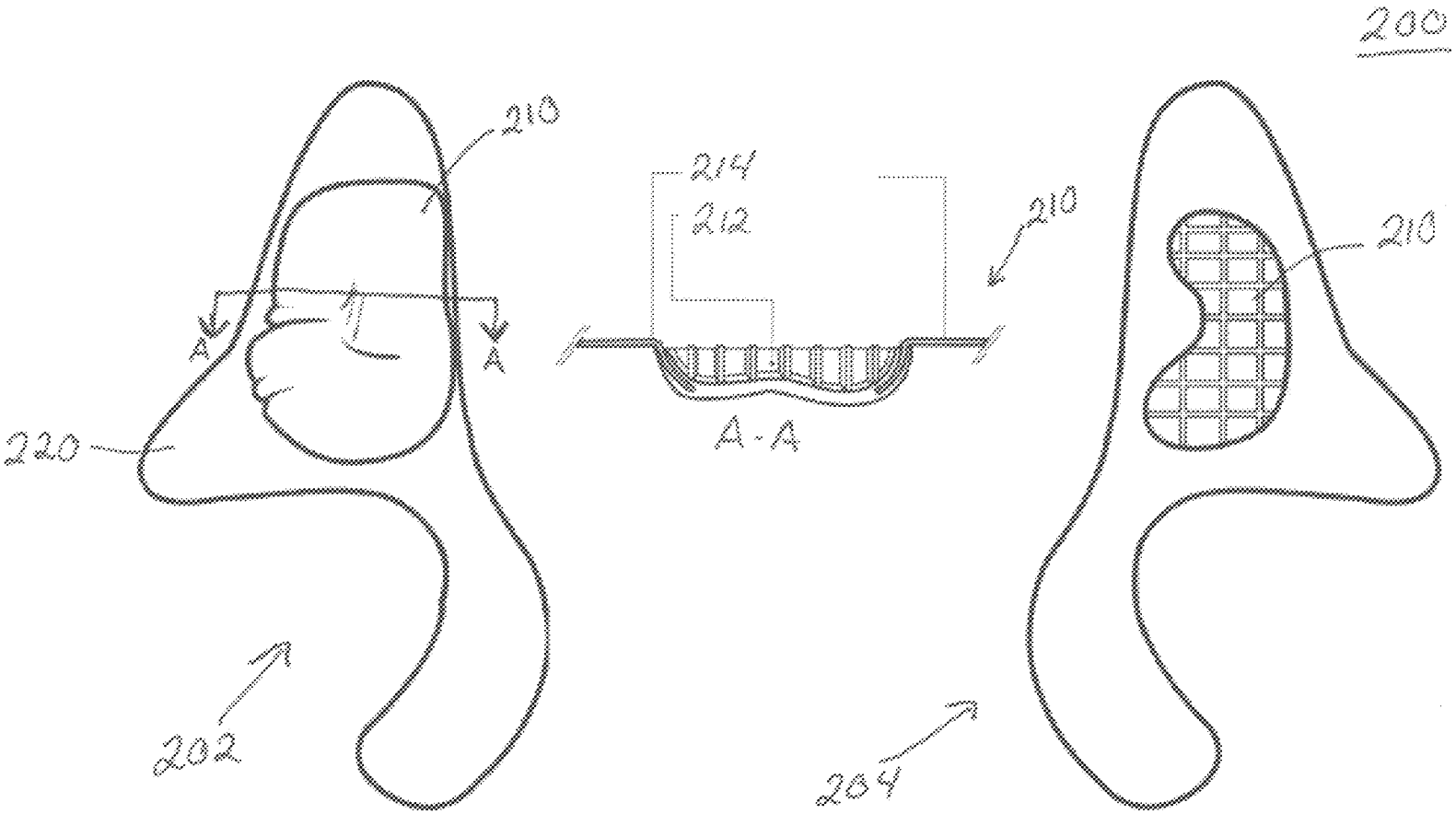
FIG. 2 depicts a basic schematic of a palm of a wrist protecting glove in accordance with one embodiment of the present invention.

FIG. 2 depicts a basic schematic of a palm of a wrist protecting glove in accordance with one embodiment of the present invention. The palm 200 generally comprises a top side 202 and a bottom side 204, both side by side in the Figure. The palm 200 generally comprises a pad 210 and a holding material 220 which is integrally formed with the pad 210 as described herein. In one embodiment, the pad 210, when viewed through the cross-section A-A, comprises waffle-patterned synthetic material 212, integrated with a fabric 214 of the holding material.

Figure 3:
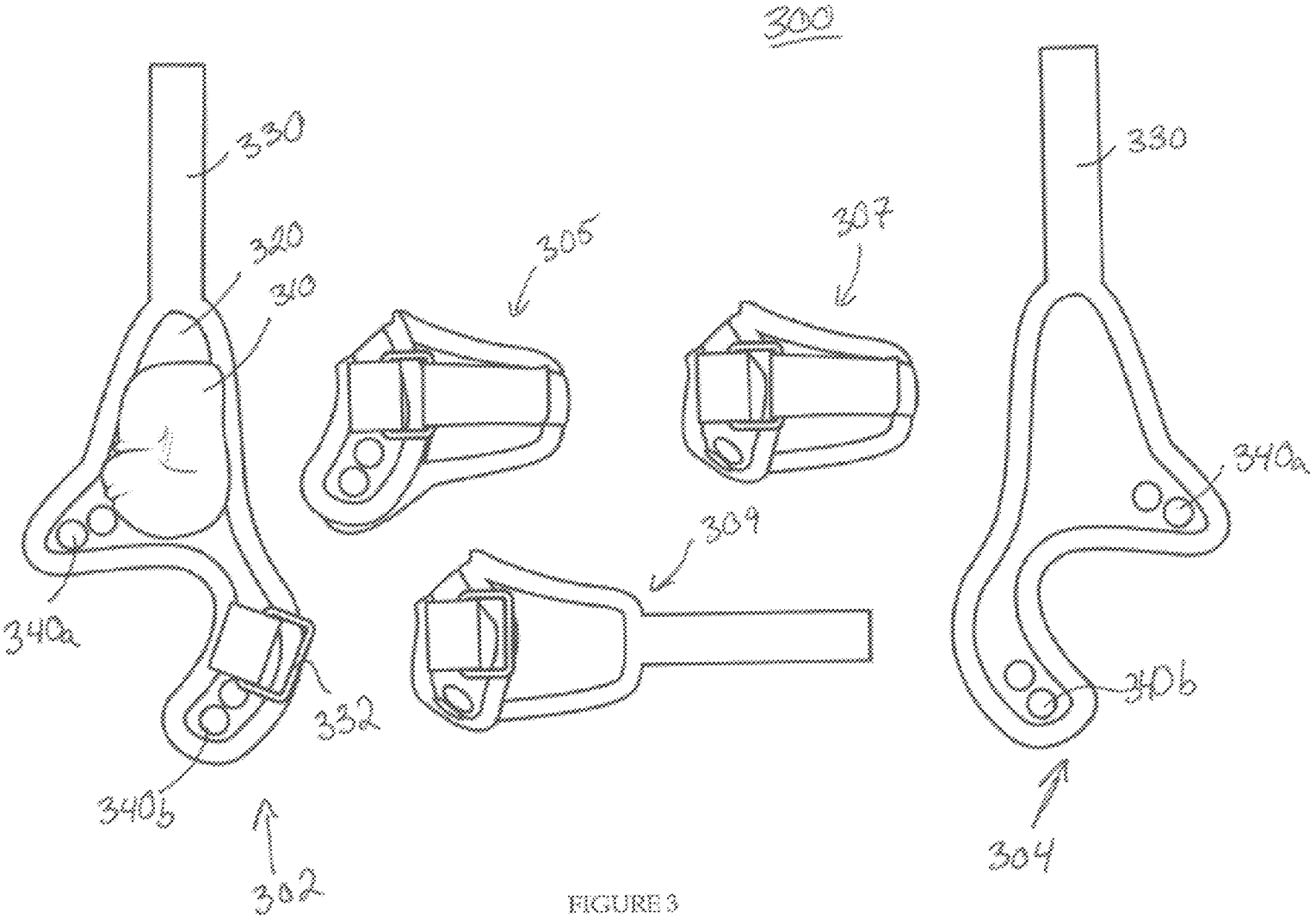
FIG. 3 depicts a basic schematic of a complete wrist protecting glove in accordance with one embodiment of the present invention.

FIG. 3 depicts a basic schematic of a complete wrist protecting glove in accordance with one embodiment of the present invention. As shown in the Figure, embodiments of the wrist protecting glove 300 are designed to provide maximum protection with minimal restriction on range of movement, allowing for a skateboarder to achieve greater maneuverability and enhanced protection at the same time. In many embodiments, the wrist protecting glove 300 can be open in a substantially flat manner, such as shown in the top view 302 and bottom view 304 of the wrist protecting glove 300.

Generally, a wrist protecting glove 300 comprises a pad 310, a holding material 320 integrally formed with the pad 310, a palm strap 330 and associated connector means 332, and optionally, a thumb closure means 340*a* and 340*b*. The palm strap 330 may comprise any type of strap or enclosure device suitable for embodiments of the present invention. In one embodiment, the palm strap 330 comprises a hook and loop fastener strap and the connector means 332 comprises a ring through which the palm strap 330 may loop therethrough and fasten onto itself. In another embodiment, the palm strap 330 may comprise a swatch of material having eye holes aligned down its length, and the connector means 332 comprises a buckle. In yet another embodiment, the palm strap 330 may comprise a snap-type assembly and the connector means 332 comprises an opposing snap.

The thumb closure means 340*a* and 340*b* comprises any fastener assembly suitable for embodiments of the present invention. Generally, the thumb closure means 340*a* and 340*b* comprises any fastener that enables the two sections of the wrist protecting glove 300 identified by 340*a* and 340*b* to substantially come together and close around a user's thumb when worn. In one embodiment, the thumb closure means 340*a* and 340*b* comprises a pair of snaps. In another embodiment, the thumb closure means comprises a hook and loop fastener, optionally comprising a similar strap and ring assembly as described above with the palm strap 330.

As shown in the Figure, the wrist protecting glove 300 may be positioned with the palm strap closed and the thumb closure means open 305, the thumb closure means closed and the palm strap open 309, or with both the thumb closure means and the palm strap closed 307. In addition, as evidenced by the top view 302 and bottom view 304, the wrist protecting glove 300 may be left completely open as well.

Figure 4:
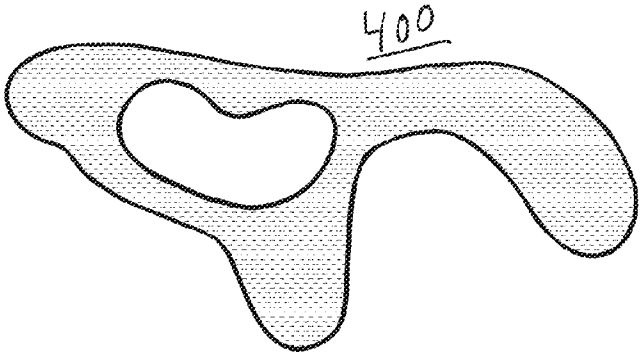
FIG. 4 depicts a design template for manufacturing the palm of a wrist protecting glove in accordance with one embodiment of the present invention.

FIG. 4 depicts a design template for manufacturing the palm of a wrist protecting glove in accordance with one embodiment of the present invention. As shown in the Figure, the template cut out 400 may be utilized with a blank of material (e.g., a fabric cloth) to carve out the basic shape of the wrist protecting glove that will be discussed in greater detail herein. Such template 400 may be used as a pattern to cut out the general design for the holding material described supra.

Figure 5:
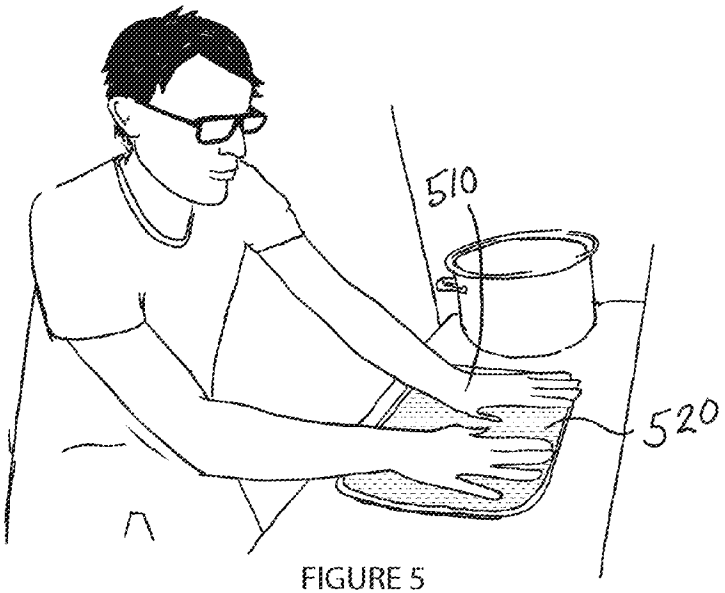
FIG. 5 depicts one exemplary embodiment of the palms of the wrist protecting glove being manufactured in accordance with one embodiment of the present invention.

FIG. 5 depicts one exemplary embodiment of the palms of the wrist protecting glove being manufactured in accordance with one embodiment of the present invention. As shown in the Figure, in one embodiment, the first step in manufacturing the palms of a wrist protecting glove is to create a mold from which the palms of the gloves can subsequently be formed. The forming of a mold may be done by creating a mold of a user's hand 510, or more specifically, a user's palms, in wax 520. In other embodiments, a machine made mold resembling a typical palm shape may be utilized, as well as any other means suitable for embodiments of the present invention.

In some embodiments, it may be desirable to create an aesthetically pleasing pattern in the mold, such that the pad has a design thereon. Accordingly, various embodiments of the present invention may comprise any of a typical hand design, an animal hand/paw design, a logo/trademark design, a character image, or the like. In one specific embodiment, the pad comprises the palm print of a gorilla, such that the distinctive lines of a gorilla's palms are exhibited on the surface of the pad. Such designs may be attained by having a user's hand decorated in such a fashion, or may be done subsequent to the general formation of the mold.

Figure 6:
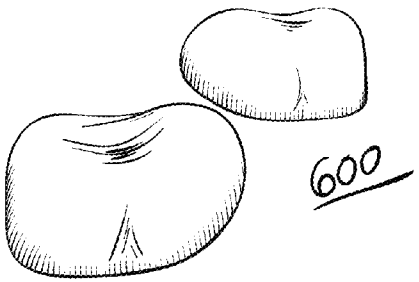
FIG. 6 depicts exemplary palms for the wrist protecting glove in accordance with another embodiment of the present invention.

FIG. 6 depicts exemplary palms for the wrist protecting glove in accordance with another embodiment of the present invention. In many embodiments of the present invention, the palms 600 of the wrist protecting glove primarily comprise a polymer pad, formed using the mold as described herein. In one embodiment, the pad is made from F-25 shore polyurethane—a common type polyurethane, often used to manufacture skateboard wheels, but with a much softer shore. In other embodiments, the pad may comprise any polymer, cellulose-based or similar material, capable of absorbing energy, and suitable for the embodiments of the present invention.

In other embodiments of the present invention, the pad may be manufactured from a natural or synthetic rubber, for example, vulcanized rubber. In yet another embodiment, the pad may comprise an air or liquid pocket, encased within a pocket of supportive material, such material comprising any of the materials described herein or the like.

Figure 7:
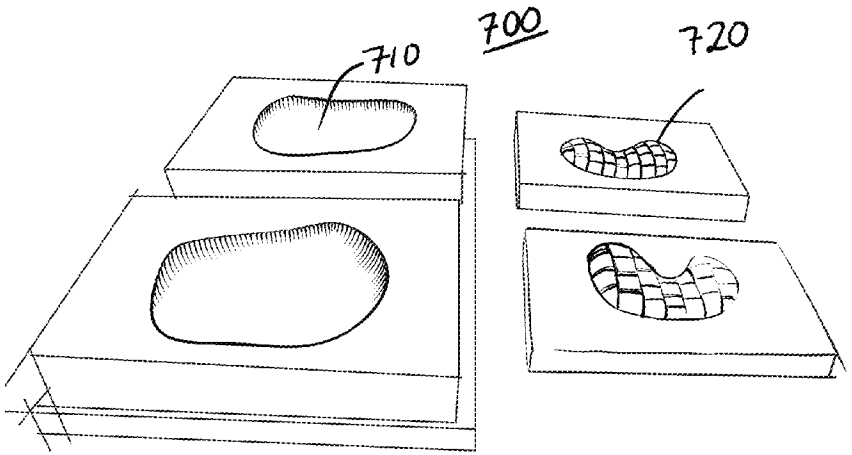
FIG. 7 depicts a means for attaching a pad to the cloth of a wrist protecting glove in accordance with another embodiment of the present invention.

FIG. 7 depicts a means for attaching a pad to the cloth of a wrist protecting glove in accordance with another embodiment of the present invention. In one embodiment of the present invention, a unique means 700 for affixing the pad to the cloth of the wrist protecting glove is provided by allowing a viscous or liquid pad material to cool and harden around at least a portion of the holding material (not shown). Using the mold 710 and optional cover 720, the viscous pad material can be integrally formed with the holding material. It is appreciated, however, any attachment means is suitable for embodiments of the present invention, for example, use of stitching or adhesives to affix the pad to the holding material is also contemplated herein.

Figure 8:
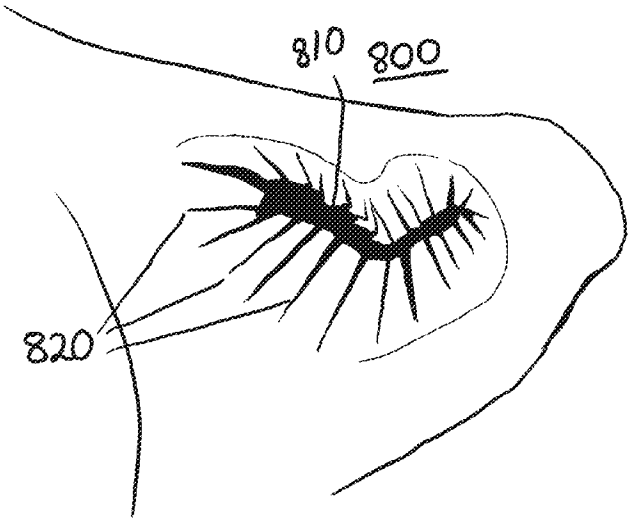
FIG. 8 depicts a waffle pattern mold for use when attaching a pad to the holding material of a wrist protecting glove in accordance with yet another embodiment of the present invention.

FIG. 8 depicts a waffle pattern mold for use when attaching a pad to the holding material of a wrist protecting glove in accordance with an embodiment of the present invention. In one embodiment, a mold 800 can be utilized to assist the cohesion between the holding material and the pad material. By utilizing such a mold, the pad material may cool and harden around the dangling cloth portions 820 of the holding material, and with proper positioning of the mold 800 behind the holding material, a very strong cohesion between the components exists. In general, the opening 810 of the holding material aligns directly behind the pad, with the holding material therebetween.

Figure 9:
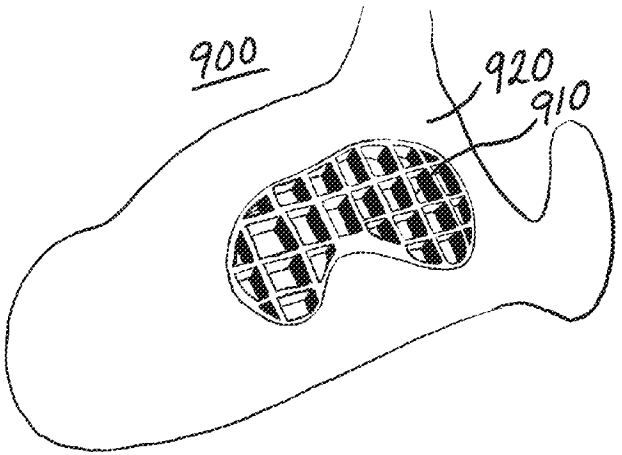
FIG. 9 depicts an exemplary pad and holding material assembly in accordance with another embodiment of the present invention.

FIG. 9 depicts an exemplary pad and holding material assembly in accordance with another embodiment of the present invention. In accordance with one exemplary embodiment, the assembly 900 comprising the pad 910 and the holding material 920 of the wrist protecting glove may be asesembled by curing the pad material (e.g., polyurethane) with the holding material (e.g., fabric) embedded into it, establishing a very strong bond. In one embodiment, this may be done by stripping up and dangling, rather than simply removing, the fabric from the center of the holding material pattern. The waffle pattern mold, as introduced above, may be positioned underneath the fabric, protrudes through an open area of the fabric, and pushes the strips of fabric down into the wet polyurethane during curing. The cured "palm" pad is then removed from the mold, and the strips of fabric are strongly secured within the mass of the pad.

Figure 11:
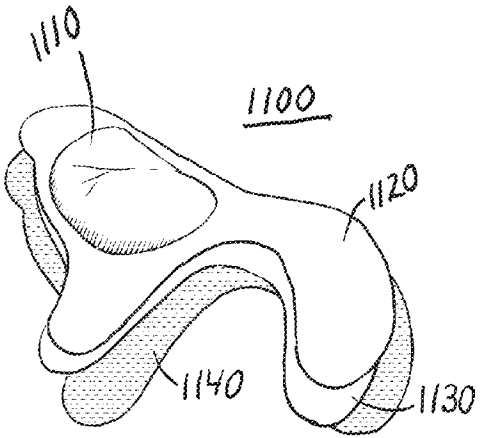
FIG. 11 depicts exemplary stacks of materials used in the assembly of a wrist protecting glove in accordance with one embodiment of the present invention.
Figure 10:
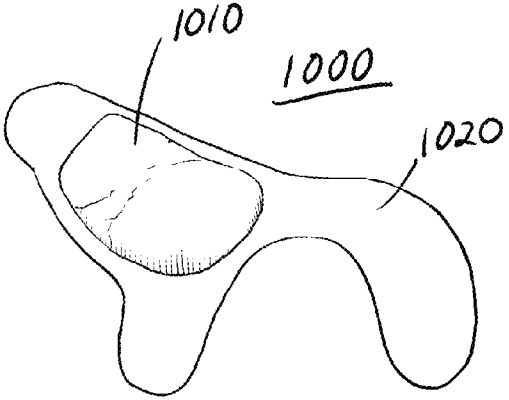
FIG. 10 depicts an exemplary resulting structure after the pad and cloth have been affixed to one another in accordance with embodiments of the present invention.

FIG. 10 depicts an exemplary resulting structure after the pad and cloth have been affixed to one another in accordance with an exemplary embodiment of the present invention. The palm portion 1000 comprises the pad 1010 and the holding material 1020, after the assembly has taken place. FIG. 11 depicts exemplary stacks of materials used in the assembly of a wrist protecting glove in accordance with one embodiment of the present invention.

In one embodiment, the materials 1100 comprise the palm having the pad 1110 and holding material 1120 assembly, a layer of padding 1130 (e.g., ¼" Styrofoam—although any padding may be suitable), and a double cloth 1140, optionally having soft padding therein. In alternative embodiments of the present invention, the materials 1100 may comprise various forms of other materials as applications may require. For example, in one embodiment, for use in colder environments, additional layers may be provided for warmth. In another example, the materials 1100 may be based upon a user's skill level and/or likelihood of injury (i.e., a novice may have an additional layer of thick padding to protect against likely falls, and an expert may have only a ⅛" layer of padding material instead of the layer of padding 1130 described above).

Figure 12:
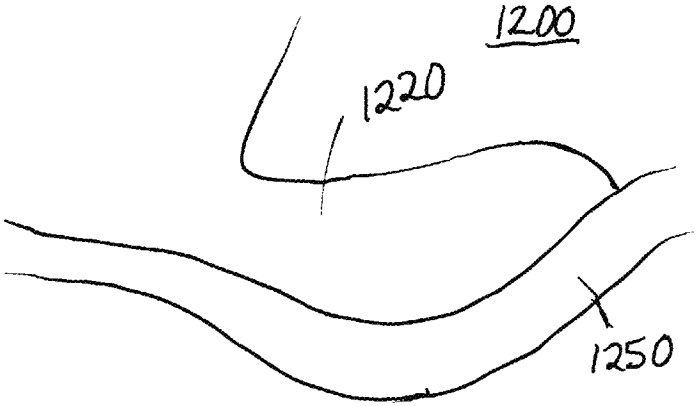
FIG. 12 depicts an exemplary assembly of a wrist protecting glove in accordance with embodiments of the present invention.

FIG. 12 depicts an exemplary assembly of a wrist protecting glove in accordance with embodiments of the present invention. In one embodiment of the wrist protecting glove 1200, the materials 1220 may be pinned and sewn along the edges to hold the pieces in place. Then, using a closure means 1250 (e.g., double-fold bias tape) may be placed around the edges of the materials 1220. Although stitching and tape is described herein, any feasible means to connect layers of fabric may be utilized with embodiments of the present invention.

Once the edges of the materials are connected together, the restraining mechanisms (i.e., the components for allowing a user to keep the wrist protecting glove on the hand during use—the palm strap and the thumb closure means) may be attached to the materials. In one embodiment, two thumb closure means (e.g., snaps) on the flaps of the materials around a thumb portion, as well as a palm strap (e.g., strap and D-ring), may be attached. Although snaps and D-rings with straps are described herein, embodiments of the present invention contemplate the use of any means for connecting the relevant portions of the wrist protecting glove, including hook and look fasteners (e.g., Velcro), a tying mechanism, a zipper, or the like, optionally in conjunction with either the snaps and/or the D-rings with straps. In one embodiment, the two flaps around the thumb portion may be manufactured as a single cloth piece, thus eliminating the need to provide a connecting means between them.

In accordance with one exemplary embodiment of the present invention utilizing "snaps" to connect the flaps of the wrist protecting glove, the snaps may serve three purposes. A first purpose is look of the apparatus, allowing the wrist protecting glove to fold open for display, and add some weight to the wrist protecting glove, for example, when hanging on a rack in a store. A second purpose for the snaps is ventilation and comfort, providing as little contact with the body as possible, thereby reducing the heat factor and making them comfortable to wear. In addition, since the snaps are behind the thumb, they receive almost no direct stress, there is no chance of the snaps popping open on impact and when doing certain normal things (like riding straight), or resting, the skateboarder may leave the flaps opened for ventilation, and close them easily when they are performing harder and more dangerous maneuvers. A third purpose is size because a user can adjust slightly by using only one snap, either forward or backward according to hand size.

Figure 13:
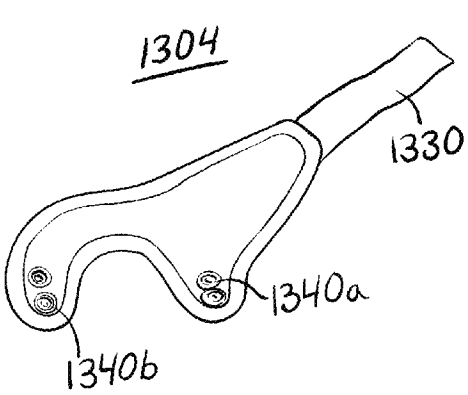
FIG. 13 depicts the underside of an exemplary wrist protecting glove in accordance with embodiments of the present invention.
Figure 14:
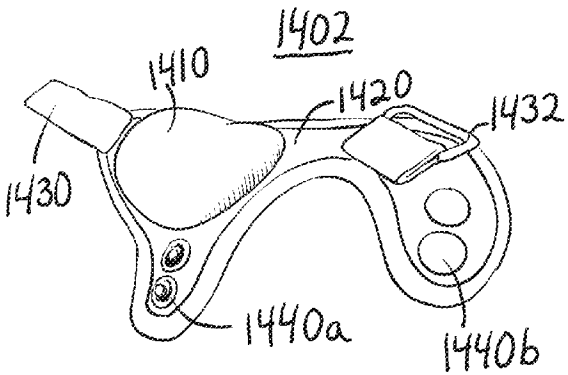
FIG. 14 depicts the topside of an exemplary wrist protecting glove in accordance with embodiments of the present invention.

FIG. 13 depicts the underside of an exemplary wrist protecting glove 1304 in accordance with embodiments of the present invention, and FIG. 14 depicts the topside of an exemplary wrist protecting glove 1402 in accordance with embodiments of the present invention. As described above, a wrist protecting glove comprises a pad 1410, a holding material 1420 integrally formed with the pad 1410, a palm strap 1330, 1430 and associated connector means 1432, and optionally, a thumb closure means 1440a and 1440*b* and an underside of the thumb closure means 1340*a* and 1340*b*.

Figure 15:
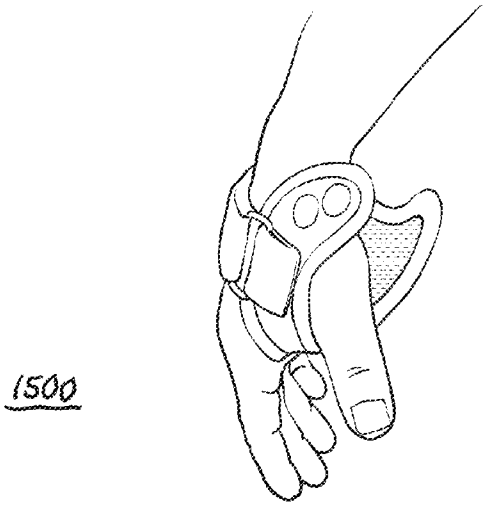
FIG. 15 depicts an exemplary wrist protecting glove being worn by a user in accordance with embodiments of the present invention.

FIG. 15 depicts an exemplary wrist protecting glove being worn by a user in accordance with embodiments of the present invention. As shown in the Figure, and in conjunction with the discussion above, a user may leave the flaps of the wrist protecting glove 1500 open, allowing the hand to "breathe," and providing better comfort for the user. Because of the nature of the straps of the device, the wrist protecting glove remains snugly fit against the user's hand.

Figure 16:
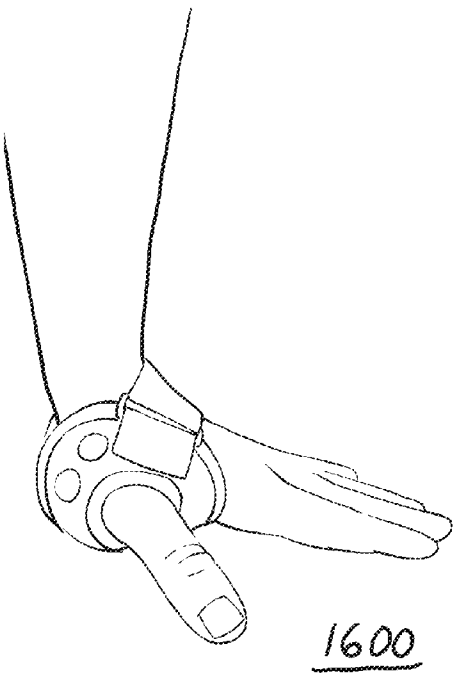
FIG. 16 depicts an exemplary wrist protecting glove in use in accordance with embodiments of the present invention.

FIG. 16 depicts an exemplary wrist protecting glove in use in accordance with embodiments of the present invention. When a user wears a wrist protecting glove 1600 in accordance with embodiments of the present invention, the impact normally absorbed by the hand and wrist during certain maneuvers is absorbed by the uniquely positioned palm of the wrist protecting glove.

It should be appreciated from embodiments of the present invention, the pad of the glove as described herein, could be similarly bonded to any manner of glove pattern and/or design, for example, a snowboarding glove or the like. Accordingly, although shown as covering only a portion of the hand in the embodiments above, alternative embodiments support the novel features of the invention described herein, embodied in any form of hand/wrist covering.

Figure 17:
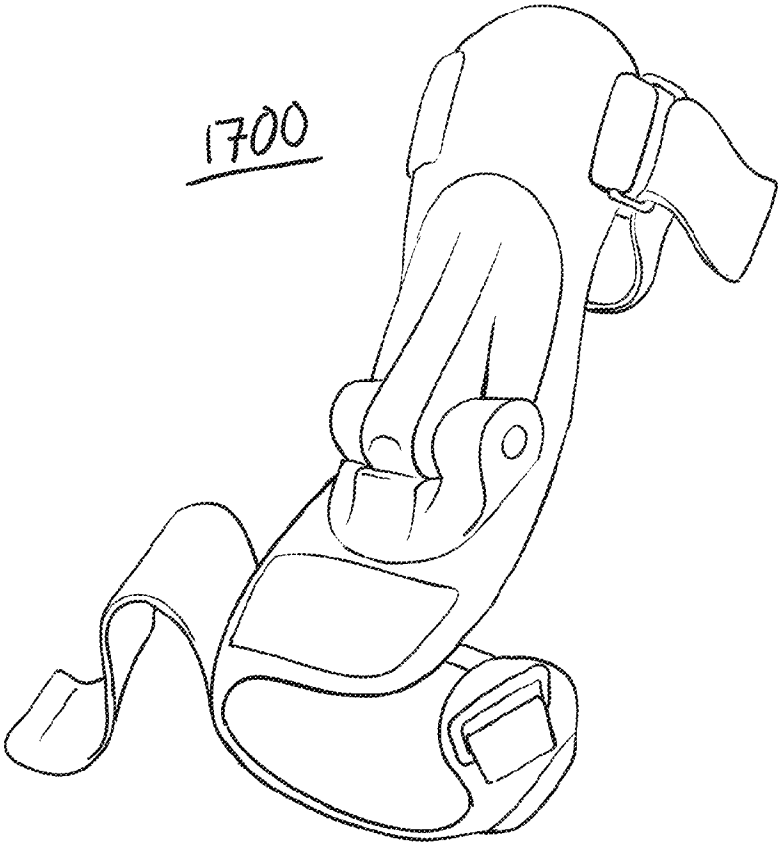
FIG. 17 depicts an alternative embodiment of a wrist protecting glove in accordance with one embodiment of the present invention.

FIG. 17 depicts an alternative embodiment of a wrist protecting glove in accordance with one embodiment of the present invention. As shown in the Figure, such type of wrist protecting glove 1700 may comprise a brace-reinforced structure that may extend down a user's arm, past the bottom of the wrist, when worn. In such an embodiment, a user may attain the benefits of traditional wrist guards, which are designed to prevent hyperextension and tensor extension, while having the additional protection afforded by embodiments of the present invention.

Figure 18:
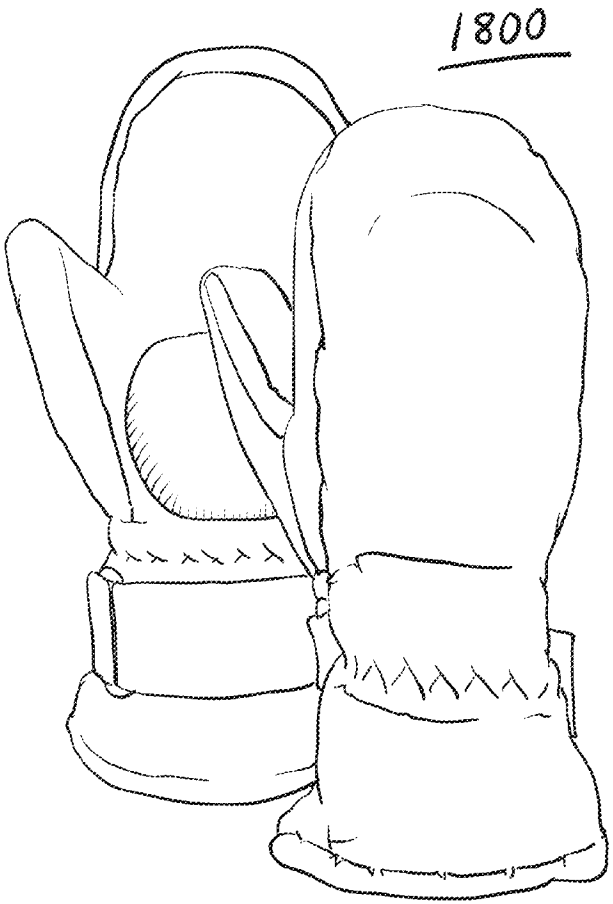
FIG. 18 depicts an alternative embodiment of a wrist protecting snowboarding glove in accordance with another embodiment of the present invention.

FIG. 18 depicts an alternative embodiment of a wrist protecting snowboarding glove 1800 in accordance with another embodiment of the present invention. As briefly mentioned above, embodiments of the present invention may be formed into any type of glove. As shown, a snowboarding glove may generally comprise a pad and holding material assembly built into the ordinary warm structure of a winter glove or mitten. In view of the forces often experienced by snowboarders, such an embodiment may prevent wrist and hand damage caused by significant impact on the user's palm.

Figure 19:
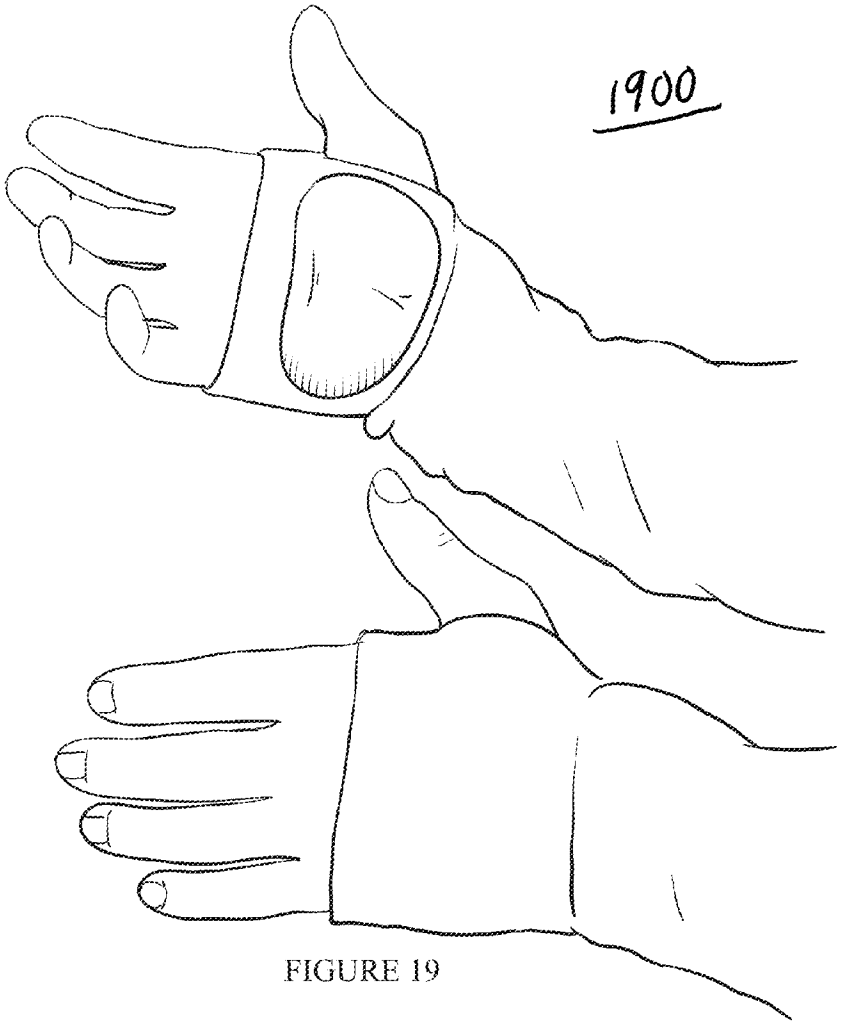
FIG. 19 depicts an alternative embodiment of a wrist protecting sweatshirt with gloves built therein, in accordance with another embodiment of the present invention.

FIG. 19 depicts an alternative embodiment of a wrist protecting sweatshirt 1900 with gloves built therein, in accordance with another embodiment of the present invention. As fashion is nearly as important to an action sportsman as the equipment itself, one embodiment of the present invention provides a sweatshirt (e.g., a hooded sweatshirt or "hoodie") or jacket having a wrist protecting glove built into the ends of the sleeves as shown. In such an embodiment, the wrist protecting glove may have While the foregoing is directed to embodiments of the present invention, other and further embodiments of the invention may be devised without departing from the basic scope thereof. It is also understood that various embodiments described herein may be utilized in combination with any other embodiment described, without departing from the scope contained herein. In addition, embodiments of the present invention may be further scalable, as particular applications may require.

What is claimed is:

1. A method of manufacturing a wrist protecting glove comprising:

cutting a holding material from a blank of material using a template;

forming pad molds by creating an impression in the form of a user's palms;

creating pads from a viscous material poured into the molds and allowing the material to harden;

affixing the holding material integrally into the pads utilizing a pad mold;

providing a stack of materials underneath the holding material and securing the materials together around a common edge; and affixing a restraining mechanism on the stack of materials, the restraining mechanism for allowing a user to keep the wrist protecting glove on the user's hand during use; and wherein the holding material comprises a plurality of dangling cloth portions and an opening.

2. The method of claim 1, wherein forming the pad molds comprises placing a user's hand in viscous wax and allowing the wax to harden.

3. The method of claim 1, wherein the pad comprises one of a polymer, cellulose-material, natural or synthetic rubber, an air pocket, a liquid pocket, or combinations thereof.

4. The method of claim 3, wherein the pad comprises F-25 shore polyurethane.

5. The method of claim 1, wherein affixing the holding material integrally into the pads utilizing a pad mold comprises:

aligning an opening of the pad mold with the opening in the holding material;

setting the holding material directly over the viscous material of the pad; and allowing the dangling cloth portions of the holding material to enter the viscous material of the pad, through the opening in the holding material, prior to the viscous material hardening.

6. The method of claim 1, wherein the stack of materials comprises a layer of padding and a double cloth.

7. The method of claim 1, wherein securing the materials together around a common edge comprises using double-fold bias tape around a top surface and a bottom surface of the stack of materials, along a common edge.

8. The method of claim 1, wherein the retaining mechanism comprises a palm strap for affixing the wrist protecting glove on a user's hand.

9. The method of claim 1, wherein the retaining mechanism comprises a thumb closure means for closing the holding material around a user's thumb.

10. A method of manufacturing a wrist protecting glove comprising:

cutting a holding material from a blank of material using a template;

forming a pad mold;

creating a pad from a viscous material poured into the mold;

providing a stack of materials underneath the holding material and securing the materials together around a common edge; and wherein creating a pad comprises:

aligning the opening of the pad mold with an opening in the holding material;

setting the holding material directly over the viscous material;

allowing dangling cloth portions of the holding material to enter the viscous material prior to the viscous material hardening; and allowing the viscous material to harden with the dangling cloth portions of the holding material embedded within.

11. The method of claim 10, wherein the stack of materials comprises a layer of padding and a double cloth.

12. The method of claim 10, wherein securing the materials together around a common edge comprises using double-fold bias tape around a top surface and a bottom surface of the stack of materials, along a common edge.

* * * * *